United States Patent [19]

Einhorn

[11] 3,995,821

[45] Dec. 7, 1976

[54] PUSH PIN

[75] Inventor: Ruediger Einhorn, Katonah, N.Y.

[73] Assignee: Coats & Clark, Inc., New York, N.Y.

[22] Filed: July 23, 1975

[21] Appl. No.: 598,365

Related U.S. Application Data

[62] Division of Ser. No. 489,051, July 16, 1974, Pat. No. 3,911,516.

[52] U.S. Cl. ..... 248/216; 24/101 R; 248/497

[51] Int. Cl.[2] ..... A47F 7/14

[58] Field of Search ..... 248/216, 217, 218, 493, 248/497, 498; 24/90 A, 90 E, 90 HA, 90 PR, 90 F, 101 SE, 101 R; 85/28, 54

[56] References Cited

UNITED STATES PATENTS

| | | | |
|---|---|---|---|
| 73,088 | 1/1868 | Gardner | 85/54 |
| 1,435,134 | 11/1922 | Boley | 85/28 X |
| 2,528,288 | 10/1950 | Rublee | 85/28 X |
| 2,864,276 | 12/1958 | Parker | 85/28 |

FOREIGN PATENTS OR APPLICATIONS

| | | | |
|---|---|---|---|
| 960,615 | 4/1950 | France | 85/28 |

*Primary Examiner*—J. Franklin Foss
*Attorney, Agent, or Firm*—Burgess, Ryan and Wayne

[57] ABSTRACT

A base member of a push pin is formed by casting or molding, and a pin is inserted pointed end first into a hole in the base member and forced through the base member until the end opposite thereof lies below the surface of the base member. The material of the base member is then flowed over the end of the pin, by mechanical or heat techniques, to form a substantially complete layer over the end of the pin within the base member. The pins preferably extend at an acute angle to a flat surface of the base member. The push pin may have pins extending from opposite surfaces thereof, a loop shaped projection adapted to be affixed to a wire, or a hinge separating the base member into a hook portion and a portion carrying one or more pins. The push pin may have a contoured base member to facilitate the affixing of a picture wire to a hook formed on the base member. In another embodiment the push pin has a projection on the side thereof through which the pin extends, the projection having a rounded contour adjacent the pin, a radially outer surface, and an intermediate axially extending section between the rounded surface and the radially outer portion. The push pin may be formed with a pivoted lever, to serve as a wire clamp. For picture hanging purposes, the push pin may include a pair of pins extending from opposite sides of facilitate an elongated member and through projections, the elongated member having a saw tooth edge, with the planes of the saw tooth edge and the side of the elongated member adjacent thereto extending at an angle corresponding to portions of a nail extending at an angle in the wall, in order to facilitte the hanging of a picture on the wall.

9 Claims, 36 Drawing Figures

26
27
30
25

26
31
27
25

26
21
25
28
20

28
20
21

29
20
21

36

36

26
27
21
25
28
23
20
24
22

26
20
21

29
20
21

45
36
35
42
44
41
43
40
37
38

44
47
46
48
50
49

53
44
43
51
43
44
53
54

57
59
58

57
56
55
58
59

61
60
57

FIG.24
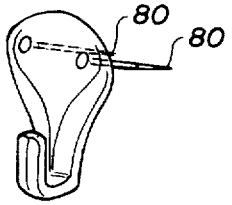
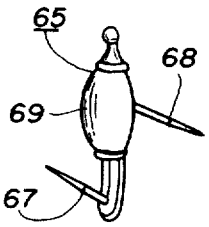
FIG.17
FIG.19
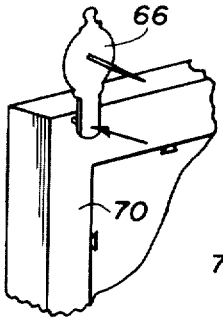
FIG.20
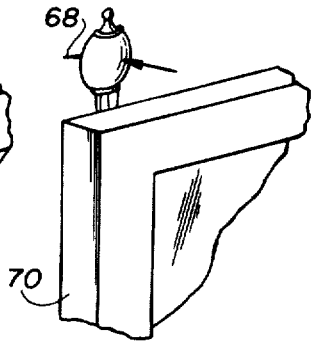
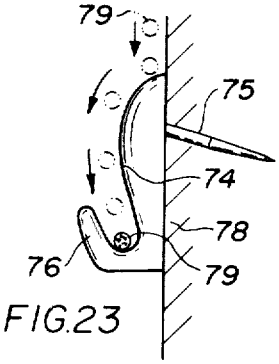
FIG.23
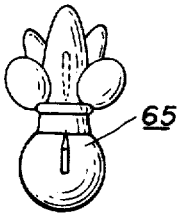
FIG.18
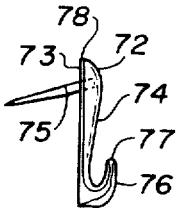
FIG.21
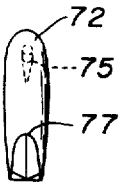
FIG.22
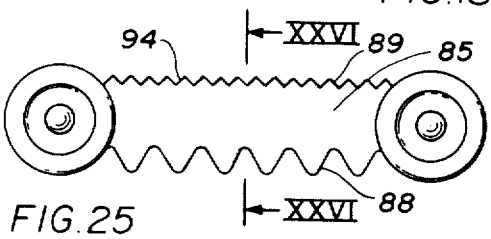
FIG.25
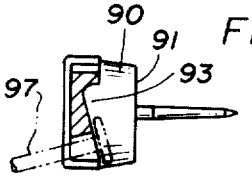
FIG.26
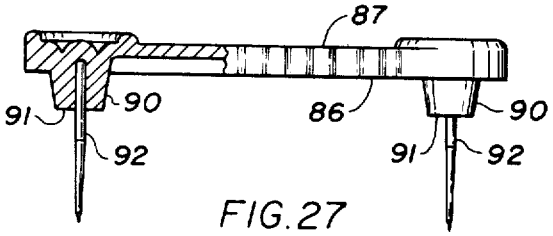
FIG.27
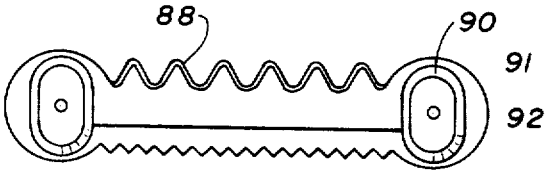
FIG.28
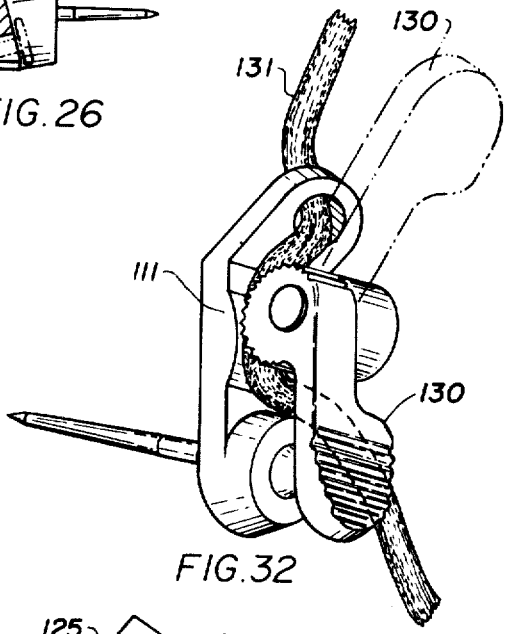
FIG.32
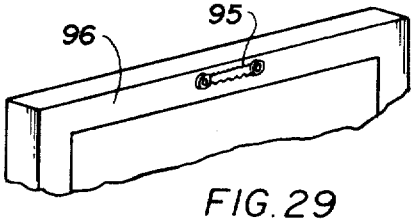
FIG.29
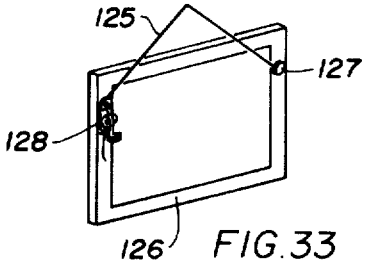
FIG.33

PUSH PIN

This is a division, of application Ser. No. 489,051, filed 7/16/74 now U.S. Pat. No. 3,911,516.

This invention relates to push pins, and more in particular to an improved technique for the installation of a pin in a base member. The invention is also directed to the provision of push pin articles made in accordance with the method.

Push pin articles are frequently provided, of the type having a pin with a sharpened end extending from a base member of the push pin. It is desirable to form such push pins by a technique whereby, when the pin is pushed by the finger of a user, there is no danger that the pin may be forced through the pushing surface of the base member and insure the user. When a push pin is manufactured by a casting or molding technique, this result may be accomplished by casting or molding the base member, depending upon the material of the base member, around the pin so that a portion of the body of the base member exists between the embedded end of the pin and the pushing surface of the base member. If the embedded end of the pin is blunt, there is little or no danger that the material of the base member will be deformed, by pushing of the push pin, to force the blunt end of the pin through the base member.

While the casting or molding technique above described produces a satisfactory article, there are occasions when the difficulties encountered in the technique undesirably increase the cost and effort required for the production of the push pin articles. For example, when the production of a push pin article is limited, the dies for producing the article are necessarily complex. This is especially true where more than one pin must be formed in the base member. In addition, separate pin feeding devices must be provided for each casting or molding apparatus when it is necessary to produce articles of different sizes. The prior art techniques for the insertion of a pin in a cast or molded base thereby have limited the numbers of types and sizes of push pin articles that were produced on a commercial basis.

In order to overcome the above problems, in accordance with the invention the cast or molded base member is provided with a hole extending therethrough. A pin is inserted in the hole, sharpened end first, and is forced into the hole until its other, blunt end, is just below the surface of the base member. The pin preferably has a diameter greater than the diameter of the hole, so that the pin is rigidly held in the base member. After insertion of the pin, the material of the base member is flowed over, to form a substantially complete layer of the material of the base member over the blunt end of the pin. By this means, the material of the base member flowed over the hole inhibits the movement of the blunt end of the pin in the axial direction, whereby there is little or no danger of injury to personnel in the use of the push pin article. When this technique is employed in the production of the push pin article, the dies for casting or molding the base member can be as simply fabricated as possible, since there is no need to consider the pin at this step of the process. A single feeding apparatus may be employed for all types and sizes of cast or molded articles, so that the expense of insertion of the pins in the base members is greatly reduced.

When the base member is die cast, the hole may be integrally cast into the base member, and the flowing of the metal of the base member can be effected by a staking operation, such as by punching the material of the base member surrounding the hole.

When the material of the base member is a thermoplastic material, the flowing operation is preferably effected with the use of heat, for example by employing a heated staking die, or by heat spinning or ultrasonic means.

The method of the invention thereby enables the provision of more complex push pin type articles, since it greatly simplifies the cost and effort involved in the insertion and holding of pin in the base member.

The method in accordance with the invention thus makes readily possible the provision of push pin articles having such features as a plurality of pins, complex contoured surfaces, and hinged components. If it were necessary to consider the insertion of the pin in the casting or molding process, in accordance with prior techniques, the production of such articles would have been unnecessarily complex.

The method in accordance with the invention is particularly advantageous in the production of the following push pin articles:

1. A push pin, especially adaptable for the mounting of pictuure frames on a wall, having one pin adapted to be inserted in the wall, and a second pin extending from an opposite surface for insertion in the frame of the picture.

2. A push pin of small size having a loop shaped projection especially adaptable for insertion in the back of a picture frame to serve as a mounting device for a picture hanging wire or alternatively to mount an object to the wall.

3. Push pin hooks, especially adapted for the hanging of pictures on a wall, having specially contoured surfaces for guiding a picture wire or hook, or hinges formed therein, to enable the hook part of the push pin to be moved away from the wall to simplify the engagement of the hook with the picture wire or a hook.

4. A push pin having a plurality of parallel pins extending from the same surface, to enable the push pin to carry more weight.

5. A multiple purpose push pin having a projection with a convex end on a projection at the pin end, in order to enable the push pin to be inserted at an angle in a wall, the projection further serving as a hook. This article may have a grooved surface on the pin side to serve in clamping an article, and the pushing surface may be concave to serve as a comfortable pushing surface.

6. A picture hanging push pin of the type having an elongated bar shaped support with pins inserted in either end for mounting the push pin on the back of a picture frame. The bar shaped element is formed with a saw toothed edge, the plane of the saw tooth edge and the side adjacent thereto being angled to conform to the supporting surfaces of a mounting nail, when the nail is driven at an angle into a wall.

7. A wire or cord clamp, especially adapted for use on a picture frame, having an eccentric cam for engaging a picture frame wire, to simplify the adjustment of the height of a picture on a wall.

The method of the invention may alternatively, of course, be employed for the insertion of other elongated members in a base member. For example, a steel shaft such as a gear axle or the like may be assembled in a base in accordance with the invention.

In the push pin articles having a hinge, or a pivoted component, it is convenient in accordance with the invention to employ a casting technique wherein one element of the push pin is first cast, and then the second element is cast, employing the hinge or axis portion of the first cast member as a portion of the mold, whereby additional elements and steps are not required for the formation of the movable joint between the elements. This technique has not been generally employed in a push pin type article in the past, since the dies, already complicated by the requirements of the hinging action, would be even more complex if it were necessary to also cast a pin in the article.

In order that the invention may be more clearly understood, it will now be disclosed in greater detail with reference to the accompanying drawings, wherein.

Figures 1, 2, 3, 4, 5, 6, 7, 8, 9, 10, 11, 12, 13, 14, 15, 16:
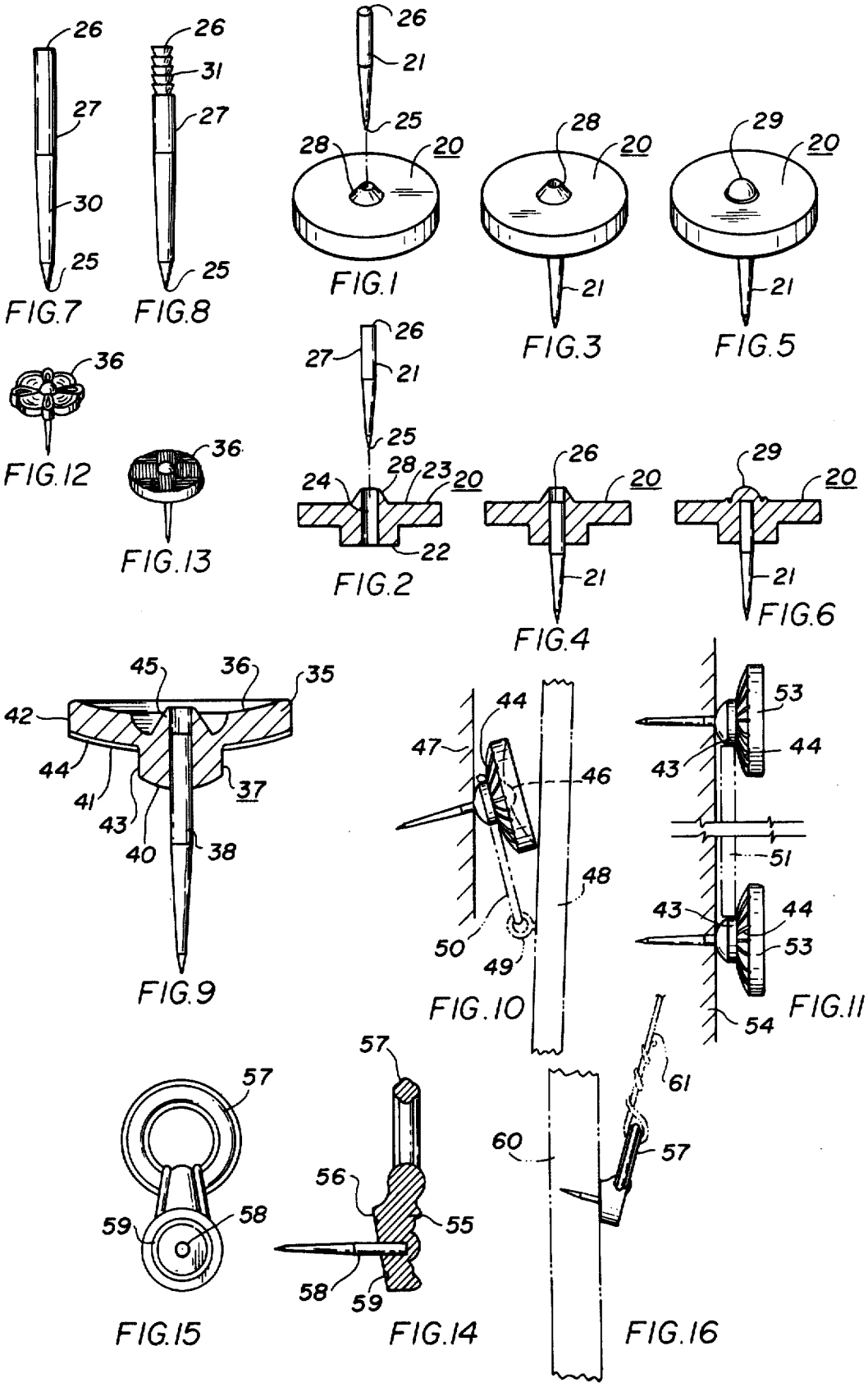
FIG. 1 is a simplified perspective view of a first step for providing a push pin article, in accordance with the invention.
FIG. 2 is a cross sectional view of the step of FIG. 1.
FIG. 3 is a simplified perspective view of a push pin article at the second step of the method in accordance with the invention.
FIG. 4 is a cross sectional view of the push pin of FIG. 3.
FIG. 5 is a simplified perspective view of a push pin article following a third step in the method in accordance with the invention.
FIG. 6 is a cross sectional view of the push pin of FIG. 5.
FIGS. 7 and 8 are simplified side views of two embodiments of a pin which may be employed in a push pin article in accordance with the invention.
FIG. 9 is a cross sectional view of one embodiment of a push pin in accordance with the invention, the illustration showing the push pin at the step of the method in accordance with the invention shown in FIGS. 3 and 4.
FIG. 10 is a simplified illustration of the use of the push pin of FIG. 9 in the hanging of a picture.
FIG. 11 is a simplified illustration of a technique for employing push pins of the type illustrated in FIG. 9 for mounting a picture on a wall.
FIGS. 12 and 13 are perspective illustrations of a push pin of the type of FIG. 9, showing different ornamentation on the heads of the push pins.
FIG. 14 is a cross sectional view of a push pin in accordance with the invention, especially adapted for the affixing of a picture wire to the back of a picture frame.
Figure 30:
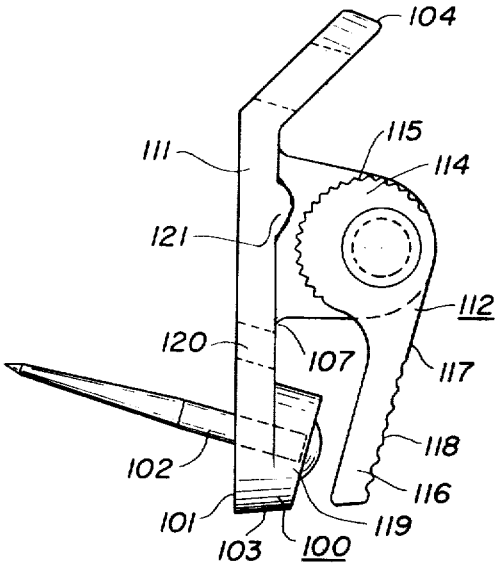
Figure 31:
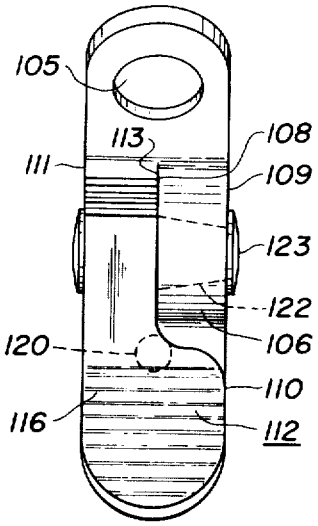
Figure 34:
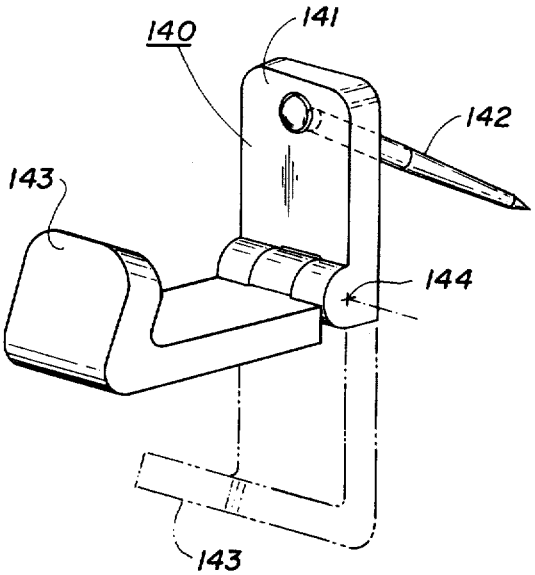
Figure 35:
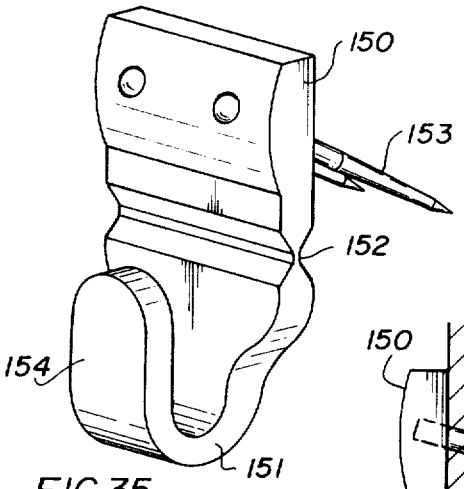
Figure 36:
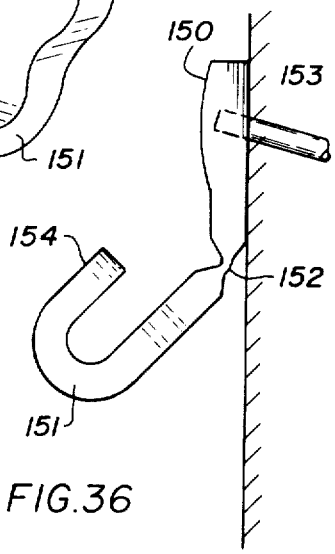

Flg. 15 is a rear view of the push pin of FIG. 14;

FIG. 16 is a simplified illustration of the mounting of the push pin of FIGs. 14 and 15 to a picture frame;

FIG. 17 is a perspective illustration of a double pin push pin in accordance with the invention;

FIG. 18 is a front view of the push pin of FIG. 17;

FIGS. 19 and 20 are rear and front perspective views respectively showing the mounting of the push pin of FIGS. 17 and 18 to a picture frame;

FIG. 21 is a side view of a push pin hook having a specially contoured surface, in accordance with the invention;

FIG. 22 is a front view of the push pin hook of FIG. 21;

FIG. 23 is a simplified side view of the push pin hook of FIGS. 21 and 22 mounted to a wall, and illustrating the engagement of a picture wire with the hook;

FIG. 24 is a perspective illustration of a modified push pin of the type shown in FIGS. 21 and 22, incorporating a pair of pins;

FIG. 25 is a front view of a push pin saw tooth picture mount in accordance with the invention;

FIG. 26 is a cross sectional view of the picture mount of FIG. 25, taken along the lines XXVI—XXVI;

FIG. 27 is a side view, illustrated partially in cross section, of the picture mount of FIG. 25;

FIG. 28 is a bottom view of the picture mount of FIG. 25;

FIG. 29 is a perspective view illustrating the mounting of the picture mount of FIGS. 25–28 on the back of a picture frame;

FIG. 30 is a side view of a push pin wire clamp in accordance with the invention;

FIG. 31 is a top view of the wire clamp of FIG. 30;

FIG. 32 is a perspective view of the wire clamp of FIGS. 30 and 31, illustrating the clamping of a wire thereby;

FIG. 33 is a perspective view illustrating the use of the clamp of FIGS. 30 and 31 in the holding of a picture wire to a picture frame;

FIG. 34 is a perspective illustration of a hinge cast picture hook, in accordance with the invention;

FIG. 35 is a perspective illustration of a molded hinged push pin hook in accordance with the invention; and FIG. 36 is a simplified side illustration of the push pin hook of FIG. 35, illustrating the hinging action thereof.

Referring now to the drawings, FIGS. 1–6 illustrate the steps of forming a push pin article in accordance with the invention. FIGS. 2, 4 and 6 are cross sectional views of the steps illustrated in FIGS. 1, 3 and 5 respectively. These figures illustrate the formation of a push pin article having a base member 20, and a pin 21. It will be apparent of course that the base member 20 illustrated in FIGS. 1–6 is exemplary only, in order to facilitate the explanation of the method in accordance with the invention, and that hence the base member may have any of a number of desired shapes or sizes, as will be apparent from the following description.

The base member 20 has first and second opposed surfaces 22 and 23 respectively, and a hole 24 extending between the first and second surfaces. The pin 21 has a sharpened end 25 and a blunt, preferably flat end 26, the shank 27 of the pin having a diameter slightly greater than the diameter of the hole 24 before assembly of the pin and base member together.

The base member 20 may be die cast, for example of a zinc die casting metal, and the hole 24 may be formed therein either as part of the casting process or by a subsequent drilling operation. It is preferred, in order to minimize manufacturing expense, that the hole 24 be die cast with the base member.

Alternatively, the base member 20 may be of a thermoplastic material, such as polypropylene, nylon or Delrin and may be formed by conventional plastic molding techniques.

It is to be noted that the base member is provided with a projection 28 extending from the surface 23 and surrounding the hole 24. This projection is formed with the base member 20 in the preferred embodiment of the invention, although it will be apparent that the method of the invention may be modified to obviate the necessity of providing such a projection.

In the formation of the push pin, the pin 21 is aligned with the hole 24, adjacent the side 23 of the base member with the sharpened end 25 of the pin directed toward the hole 24, as illustrated in FIGS. 1 and 2. The pin is then forced into the hole 24, from the side 23, until the sharpened end 25 thereof extends beyond the surface 22 of the base member, and the blunt end 26 lies below the surface 23, as illustrated in FIGS. 3 and 4. The reference to the phrase "below the surface" in this regard refers to the fact that the pin is forced to such a position that a portion of the hole is exposed between the blunt end of the pin and the adjacent end of the hole.

In the next step of the method, the material of the base member is flowed into the end of the hole adjacent the blunt end of the pin, as is more clearly apparent in FIG. 6. As a consequence, the portion of the hole between the blunt end of the pin and the surface 23 becomes substantially completely filled with the material of the base member. The term "flowing" as employed herein refers to a process whereby the material of the base member is plastically deformed, either by mechanical action or the action of heat, to move the material of the base member adjacent the hole 24 into the hole.

When the base member is formed of a die cast material, the metal of the base member may be swaged over by a staking operation, which may be effected by a punch press, spinning or radial staking, or a high speed hammering operation. As an example, when a projection 28 has been formed on the base member, a staking punch may be provided having an ornamental shape to provide a decorative projection on the base member over the blunt end of the pin, such as the hemispherical projection 29 as illustrated in FIGS. 5 and 6. Thus, when the base member material is a die cast material, it is preferable that the flowing of the metal be effected by mechanical means.

While FIGS. 1 through 6 illustrate the formation of a completed push pin having an ornamental projection 28, due to the provision of the necessary shaped projection 28 illustrated in FIGS. 1–4, it will be apparent that the flowing of the metal may also be effected without the formation of a projection on the base member. In this case, the projection is suitably designed so that the staking operation, for example, by spinning results in a flat surface of the metal of the base member covering the pin.

When the base member is formed of a thermoplastic material, the staking or flowing may be effected by heat staking (i.e., employing a heated staking tool), by locally ultrasonically heating the plastic material to effect the flowing thereof, or by a heat spinning operation to spin the thermoplastic material over the blunt end of the pin.

In one example of the production of a push pin in accordance with the invention, the base member 20 was die cast of Zamak zinc die casting element, the hole 24 having been cast in the base member. The hole 24 had a diameter of about 0.040 inches, and the diameter of the shank of the pin was 0.045 inches. In this example, the projection 28 was in the form of a frustum of a cone with a major base diameter of 0.120 inches, a top diameter of 0.060 inches, the angle between the axis and sides of the frustum being 34°. The staking tool was formed with a concave staking face having a radius of 0.060 inches, to form the projection 29 of the same shape. Following the staking operation, a layer of the base member metal of about 0.030 inches covered the blunt end of the pin. Prior to the staking operation, the pin had been forced into the hole so that its blunt end was approximately 0.05 inches below the top surface of the frustoconical projection 28.

Since a layer of the material of the base member covers the blunt end of the pin, following the formation of a push pin in accordance with the invention, the pin 21 is axially restrained and the danger of the blunt end of the pin 21 passing through the surface 23 of the push pin, and thence into the finger of a user, upon the application of pressure to the pin is overcome.

A typical pin 21 for use in the method of the invention is illustrated in FIG. 7. The shank portion 17 of this pin, adjacent the blunt end 26 has a straight smooth surface. The portion 27 is adapted to be embedded within the base member. A long tapered portion 30 extends between the shank 27 and the pointed tip 25. The pin may be made, for example, of heat treated carbon steel. In another embodiment of a pin that may be employed in the process of the invention is illustrated in FIG. 8, wherein the end of the shank 27 toward the blunk end 26 is provided with barbed self locking annular grooves 31, which serve to more firmly hold the pin 21 in the base member. It will be apparent of course that the pin 21 may be provided with other types of formed areas in its flank portion to assist in holding the pin within the base member. As above described, the diameter of the flank portion of the pin is slightly greater than the diameter of the formed hole 24 in the base member, so that the pin 21 is force fit in the base member. This ensures that the pin is held in the base member by sufficient pressure that it will not easily fall out or be pulled out of the base member.

One example of a push pin in accordance with the invention is illustrated in FIGS. 9–13. FIG. 9 illustrates a cross-sectional view of the push pin prior to the final staking operation.

In the push pin illustrated in FIG. 9, the base member 35 is generally circular, and has a front preferably concave surface 36 and a rear surface 37, through which the pin 38 extends. The pin 38 preferably extends coaxially through the base member.

The rear surface 37 has a convex portion 40 adjacent the pin 38, a portion 41 extending radially inwardly from the outer edge 42 of the base member, and an intermediate portion 43 between the portions 40 and 41. The portion 43 may have a circular cross section, and be coaxial with the pin 38. The annular surface 41 may also be convex, and is preferably provided with radially extending grooves 44.

When the projection 45 of the surface 36 is staked in accordance with the invention, the surface 36 may thus be formed with a hemispherical projection 46 at its center, as illustrated by the dash lines in FIG. 10.

The push pin of FIGS. 9-13 may be employed in a number of different manners. For example, it may be employed in the same manner as a conventional thumb tack. Further, as illustrated in FIG. 10, the push pin may be inserted at an angle in a wall 47, due to the provision of the convex surface 40. In other words, since the surface 40 is not flat, complete insertion of the pin in the wall is not inhibited even if the pin extends at an angle into the wall.

As illustrated in FIG. 10, the push pin may also serve as a hook, for example, for hanging a picture from a wall. Thus, in conventional manner, a picture frame, a portion 48 of which is illustrated in FIG. 10, is provided with an eye 49 through which a picture hanging wire 50 is affixed. The wire 50 may be hung over the pin, as illustrated in FIG. 10, with the wire engaging the intermediate portion 43 of the push pin.

Alternatively, as illustrated in FIG. 11, the push pin may be employed to hold a picture 51 or similar article against a wall, without piercing the picture. In this case, the push pins 52 and 53 are pushed into the wall 54 above and below the picture, without piercing the picture, so that the picture is held between the intermediate rear surfaces 43 of these pins. The grooves 44 in the surface 41 act as gripping grooves, to enable the more firm holding of the picture 51 on the wall.

The concave shape of the front surface 36 is provided in order to facilitate the pushing of the push pin with a finger. The surface 36 may be formed with any desired ornamental design, as illustrated in FIGS. 12 and 13. It is preferred that the outer edge 42 of the pin be irregular, for example, by the provision of an ornamental design, as illustrated in FIG. 12, to facilitate the removal of the pin by rotation. In other words, the ornamental design at the edges of the pin facilitates grasping by the fingers, so that the pin may be readily rotated and withdrawn from the wall.

In a typical pin of the type illustrated in FIGS. 9–13, the push pin has an overall diameter of 0.475 inches, the base member having an overall height of 0.19 inches. The convex portion 40 had a radius of curvature of 0.18 inches, the convex portion 41 had a radius of curvature of 0.8 inches, and the concave portion 36 had a radius of curvature of 0.72 inches. The intermediate portion 43 was cylindrical with an axial length of about 0.05 inches. The radial extending grooves 44 had depths of about 0.01 inches.

Another form of push pin in accordance with the invention is illustrated in FIGS. 14–16. This push pin is especially adaptable for insertion in the rear of picture frames to facilitate the attachment of a picture wire thereto. This pin has a base member 55 with a flat surface 56. A loop shaped projection 57 extends from the base. The blunt end of the pin 58 is embedded in and rigidly held by the base member 55 and extends through the flat surface 56. A decorative annular groove 59 may be provided in the flat surface 56 coaxial with the pin 58.

In the embodiment of the invention illustrated in FIGS. 14–16, the plane of the loop shaped projection 57 is normal to the pin 58, and the flat surface 56 forms an acute angle with the plane of the loop shaped projection 57. The perpendicular relationship between the pin and the plane of the loop shaped projection is not absolutely necessary, and in more general terms, the pin extends at an acute angle to a given direction along the flat surface 56, and the loop shaped projection extends from the base in a plane, away from the flat surface at an acute angle to the given direction. Preferably, the angle between the flat base 56 and the pin 58 is about 75°.

As illustrated in FIG. 16, when the push pin is inserted in the rear of a picture frame, illustrated generally at 60, the loop shaped projection is in a plane at an angle of about 15° to the rear of the picture frame. A suitable picture hanging wire 61 may be affixed to the loop of the loop shaped projection. Thus, a similar push pin may be inserted at each side member of the picture frame, with the picture wire extending therebetween for hanging the picture on a wall. The angular relationship between the loop shaped projection and the flat surface 56 facilitates the affixing of the wire to the loop shaped projection. The acute angle formed between the pin and the flat surface 56 provides for a more positive holding of the push pin in the picture frame. In an alternative method for employing the push pin of FIGS. 15 and 14, the pin may be inserted in the rear of the top of the picture frame, with the hook shaped projection extending above the picture frame. The loop of the loop shaped projection may thus be employed as an eye for hanging the picture on a suitable hook in the wall.

The push pin of FIGS. 14 and 15 has a low profile, i.e., a small depth between the flat surface and the end of the loop shaped projection, and a push pin of this type may be relatively small, for example, having a maximum dimension in the plane of the loop shaped projection of from about one-half to three-fourths of an inch, with a maximum height from the picture frame of about three-sixteenths to five-sixteenths inches.

The push pins of FIGS. 14–16 may be inserted in the rear of the picture frame merely by pushing them in with a finger, whereby their installation is more convenient and versatile than a conventional screw eye. Since the push pin may be cast or molded, it may also be formed in an ornamental manner for more pleasing appearance. A pilot hole in the picture frame is not needed, and there is substantially no danger that the push pin in accordance with the invention will split a picture frame. It is also apparent that the push pin may be employed as a general purpose hanger, by inserting the pin in a wall and employing the loop shaped projection for hanging articles.

A still further push pin, in accordance with the invention is illustrated in FIGS. 17–20. This push pin has a base member 65 with a flat surface 66. A pair of pins 67 and 68 have blunt ends completely embedded in and rigidly held by the base member 65. The pin 68 has a pointed end extending from the flat surface 66, and the pin 67 has a sharpened end extending from the surface 69 of the base member opposite the flat surface 66. The pins 67 and 68 extend in a common plane normal to the flat surface 66, the direction of extension of the pin 67 through the flat surface 66 being spaced from the point at which the pin 68 intersects the flat surface.

The pins 67 and 68 are preferably parallel and in order to enable more positive holding, it is preferable that the pins extend at an angle of about 75° to the plane of the flat surface 66.

One or both of the pins 67 and 68 may be affixed in the base member by means of the technique described with reference to FIGS. 1–6.

The push pin of FIGS. 17–20 is particularly adaptable to the holding of a picture frame to a wall. Thus, as illustrated in FIG. 19, the push pin may be affixed to the top of a picture frame, a portion 70 of which is illustrated by insertion of the pin 67 into the top of the frame from the rear thereof. This may be effected by pressure with the finger in the direction indicated by the arrow. Then, as illustrated in FIG. 20, the picture frame 70 is held against the wall, and the pin 68 inserted in the wall by pressure with the finger in the direction indicated by the arrow in this figure. The angled orientation of the pins in the preferred embodiment of the invention provides positive holding of the picture frame to a wall.

In a preferred method for fabricating the push pin of FIGS. 17–20, the upper pin 68 is cast in the base member and the lower pin 67 is inserted in the base member in the technique illustrated in FIGS. 1–6, in order to overcome the problems involved in the casting of both pins in the base member.

A still further push pin in accordance with the invention is illustrated in FIGS. 21–23. This push pin has a base member 72 with a flat surface 73 and a contoured surface 74 opposite the flat surface. A pin 75 has a blunt end embedded in and rigidly held by the base member, and a sharpened end extending from the flat surface 73. A hook 76 extends from the base member 72.

In the embodiment of this push pin illustrated in FIGS. 21–23, the hook 76 joins the base member 72 at one end of the base member and extends upwardly therefrom. This relationship is not absolutely necessary since the base member may have an extension below the hook 76. In more general terms, in accordance with the invention, the hook extends from the contoured surface, with the projection of the end 77 of the hook on the flat surface 73 being spaced from the projection of the junction of the hook and the contoured surface on the flat surface 73 in a given direction, i.e., upwardly in the illustrated embodiment of the invention. The projections in this definition are taken in a vertical central plane of the base member normal to the flat surface 73.

Viewing the base member in a direction normal to the above plane, as illustrated in FIG. 21, it is apparent that the contoured surface 74 has a smooth contour extending from the intersection with the hook 76 upwardly to the upper edge 78 of the base member where it substantially joins the upper end of the flat surface 73. The contour above described may lie in the central plane of the base member normal to the flat surface 73, although from the following criteria, it will be apparent that this relationship is not necessary. The pin 75 preferably extends at an obtuse angle to the direction between the intersections of the junction of the hook with the contoured surface and the end of the hook on the flat surface 73. In other words, in the illustrated embodiment of the push pin, the pin 75 preferably extends at a slightly downward angle, i.e., at about 105° to said direction. In addition, in order to enable the push pin to be inserted in a wall, the pin 75 preferably intersects the flat surface 73 below the upper edge 78, and above the end 77 of the hook. In more general terms, the pin intersects the flat surface at a point in a first plane normal to the flat surface and normal to the above-discussed central plane, the second plane intersecting the first plane between the upper edge of the base member and the end 77 of the hook.

As illustrated in FIG. 23, when the push pin of FIGS. 21 and 22 is inserted in a wall 78, a wire of a picture to be hung may be readily moved to engage the hook of the push pin. FIG. 23 illustrates a sequence of position 79 of a picture wire, in the process of hanging a picture on the hook, whereby engagement of the picture wire with the hook 76 is positively assured. Initially, the picture is held against the wall, so that the wire takes the uppermost position illustrated in FIG. 23. Due to the smooth contoured surface 74 of the push pin, as above discussed, lowering of the picture will affect the movement of the picture wire downwardly along the contoured surface, in the direction indicated by the arrow, so that the picture wire reaches its lowermost position as illustrated, in engagement with the hook 76, without the necessity of fumbling with the picture wire to insure its engagement with the hook 76. The smooth contoured surface above described inhibits snagging of the picture wire.

The angled orientation of the pin 75, as above described, insures positively holding of the push pin in the wall. In the arrangement illustrated in FIGS. 21–23, a single pin 75 is provided, preferably extending in the central vertical plane of the push pin. In order to provide a push pin hook capable of supporting greater weights, a plurality of pins 80 may be provided extending from the flat surface as illustrated in FIG. 24. The pins 80 are oriented generally in the fashion described with reference to FIGS. 21 and 22, although they are preferably disposed symmetrically on opposite sides of the central vertical plane of the push pin normal to the flat surface 73.

A further push pin, in accordance with the invention, is illustrated in FIGS. 25–29. This push pin device is adapted for the mounting on the back of a picture frame, to engage a wall hook or nail for holding the picture on the wall.

Referring to FIGS. 25-28, the push pin has an elongated base 85, of generally rectilinear cross section, with opposite sides 86 and 87 joined by opposite edges 88 and 89. A projection 90 is provided extending from the side 86 at each end of the base, the ends 91 of the two projections defining a plane which, as will be apparent from the following description, corresponds to the surface of the picture frame onto which the push pin is mounted.

A pin 92 is provided at each projection 90, the pins having blunt ends imbedded in and rigidly held by the material of the base, and sharpened ends extending from the projections in a direction away from the side 86 of the push pin. The pins 92 preferably extend normal to the plane defined by the ends 91 of the push pin. If desired, the ends of the base 85 may be generally rounded, as illustrated. The edge 88 of the base has a sawtooth shape, and the portion of the surface 86 adjacent the edge 88 extends in a plane at an acute angle, (preferably 15°) to the plane defined by the ends of the projections, as is more clearly apparent in FIG. 26. Thus, the angled portion 93 of the side 86 is closer to the plane defined by the ends of the projections 91 at the edge 88 than at the edge 89. The edge 88 also extends at an acute angle to the plane defined by the ends 91 of projections 90, the edge 88 also preferably being normal to the plane of the portion 93 of side 86 of the base. In other words, transverse lines across the edge 88, between the sides 85 and 86, are at a determined acute angle to the plane defined by the ends 91, and are preferably normal to the plane of the portion 93 of side 86.

The edge 89 of the base 85 is preferably provided with friction grooves 94 extending transversely between the sides 85 and 86. The side 87 may be parallel to the plane defined by the ends of the projections 90, as illustrated in FIG. 26. Further, the angled portion 93 of the side 86 may be in the form of a groove in the side 86, as appears in FIG. 27, so that adequate width is provided at the edges 88 and 89 to enable use of these edges in the hanging of a picture.

As illustrated in FIG. 9, the push pin 95 of FIGS. 25–28 is mounted on the rear of the upper frame member 96 of a picture frame, with the base of the push pin extending horizontally. The push pin 95 is mounted on the picture frame merely by pushing the pins 92 into the back of the picture frame. If the picture is to be mounted on a nail or similar article extending from a mounting wall, the push pin 95 is oriented with the saw tooth edge 88 extending downwardly. In order to provide greater strength in the mounting of the picture, the nail 97, as illustrated partially in FIG. 26, extends downwardly into the wall (not shown). The picture frame is then mounted on the wall, with the saw tooth edge 88 engaging the top of the end of the nail 97 extending from the wall, as illustrated in FIG. 26. Due to the angled orientation of the edge 88 and the rear portion 93 of the base, the head end of the nail is positively engaged by the push pin. Thus, if the nail has been mounted in a wall at an angle of about 75° to the wall, the underside of the head of the nail will rest firmly against the surface portion 93 of the push pin, and the edge 88 will positively engage the upper side of the shank of the nail adjacent the head thereof.

It is apparent of course, that the saw tooth edge 88 is provided in order to enable adjustment of the picture, whereby the picture may be mounted with a selected groove of the saw tooth edge engaging the nail to ensure the proper positioning and alignment of the picture.

On occasion, it is desired to mount a picture by means of a hook affixed to a wall. In this event, the push pin 95 is oriented with the friction grooves 94 extending downwardly, the picture being hung by engaging the friction grooves 94 with the wall hook in the conventional manner. In a typical push pin in accordance with FIGS. 25–29, the pin may have an overall length of about 2 and ⅔ inches, and an overall depth of about one-fourth inch. The projections 90 may have length of about one-eighth inch, in order to space the base 85 from the back of the picture frame, so that it can properly engage a nail in the wall or a hook mounted on the wall.

FIGS. 30–33 illustrate a still further embodiment of a push pin in accordance with the invention. This push pin is particularly adaptable for use in the hanging of pictures, and it enables the adjustment of the picture wire mounted to the frame of a picture. The push pin comprises a base 100 having a flat mounting surface 101. A pin 102 has a blunt end completely enclosed in and rigidly held in the base 100, adjacent one end 103 of the base member, and a pointed end extending from the flat surface 101.

A projection 104 extends from the other end of the base, the projection 104 having an aperture 105. In the preferred embodiment of the invention as illustrated in the figures, the axis of the hole 105 and the axis of the pin 102 lie in a common central plane of the base 100 normal to the flat surface 101, and the projection 104 extends at an angle of about 45° to the plane of the flat surface 101.

A projection 106 extends from the surface 107 of the base opposite the flat surface 101, the projection having a surface 108 lying in or parallel to the common plane of the aperture 105 and pin 102. The projection 106 extends upwardly from the surface 107 generally centrally with respect to the ends of the base 100 and, in the illustrated embodiment of the invention, has a flat outer side 109, parallel to the surface 108, the side 109 thereby constituting an extension of the flat edge surface 110 of the base between the flat surface 101 and the upper surface 107 thereof. The opposite edge 111 of the base may also be flat and parallel to the edge 110.

A latching lever 112 is pivotally mounted to the projection 106 about an axis parallel to the flat surface 101 and normal to the above common plane of the hole 105 and pin 102. For this purpose, the projection 106 is provided with a suitable aperture. The latching lever 112 has a flat surface 113 slidably engaging the flat surface 108 of the projection 106.

The portion of the lever 112 in the vicinity of the rotational axis thereof is eccentric, and forms a cam 114 having peripheral axially extending teeth 115. An operating lever 116 extends from the cam 114, to enable the rotation of the cam 114. For example, the upper surface 117 of the operating lever 116 may extend tangentially from the cam 114 at a location adjacent the portion of the cam surface closest to the axis of rotation. The operating lever 116 extends toward the end 103 of the base. The top surface 117 of the operating lever may be provided with grooves 119 or other surface markings to inhibit the slipping of a finger thereon.

As illustrated in FIG. 31, the edges of the lever 112 may be generally aligned with the edges of the base 100, the operating lever 116 thereby being wider than the cam 114.

As illustrated in FIG. 30, a boss 119 may be provided in the upper surface 107 adjacent the end 103, the upper edge of this boss being generally parallel to the lower surface of the operating lever 116 when the operating lever 116 is moved close thereto. The boss 119 thereby provides a thickened portion on the base, to facilitate the holding of the pin 102.

The pin 102 preferably extends at an angle of about 75° to the flat surface 101, in the direction toward the other end of the base. This feature enables the push pin to be more positively held in use. The base may also be provided with a central aperture 120 between the projection 106 and the boss 119, so that a mounting screw may be employed for more firmly holding the push pin to a surface if necessary. It is preferable that the axes of the hole 105 and hole 120 extend parallel to the pin 102, in order to simplify the formation of the base by a casting operation.

As illustrated in FIG. 30, when the operating lever 116 is moved adjacent the boss 119, the surface of the cam 114 lying the greatest distance from the rotational axis is directed toward the top surface 107 of the base. If desired a suitable projection 121 may be provided on the top surface 107 in the region of the cam, whereby the projection 121 cooperates with the cam to clamp a wire or cord therebetween.

The push pin illustrated in FIGS. 30-32 may conveniently be formed by first die casting the base with the boss 119, projection 106 and projection 104, with a tapered hole 122 in the projection 106 as indicated in FIG. 31. The latching lever 112 is then cast onto the cast base, using the cast base as a portion of the mold, whereby the pivot of the latching lever is formed integrally with the lever, and a head 123 is formed on the pivot to prevent removal of the latching lever from the assembly.

The arrangement of FIGS. 30–32 may be employed, for example as illustrated in FIG. 33, for adjustably holding a picture wire 125 to the back of a picture frame 126. One end of the wire may be held by a non-adjustable support 127, for example the push pin illustrated in FIGS. 14–16. The other end of the picture wire 125 is held by a clamp 128, in accordance with FIGS. 30–32. The portion at which the picture wire is clamped in the clamp 128 may thus be readily adjusted, in order to enable the adjustment of the vertical position of the picture on a wall with great ease. Thus, in the past vertical adjustment of a picture has required either movement of the hook on the wall, with consequent frequent damage to the wall, or by adjustment of the connection of the wire to a conventional hook. When a clamp in accordance with the FIGS. 30–32 is employed, however, the process of shortening or lengthening the wire, to effect the vertical adjustment of the picture, is greatly simplified.

FIG. 32 illustrates the manner in which the wire or cord clamp is employed. Initially, the latching lever 112 is moved to its uppermost position, as illustrated at 130 by the dashed lines. The wire 131 to be clamped is then fed through the hole 105, between the space between the cam 114 and projection 121, and then behind the boss 119. The latching lever 112 is then rotated with the operating lever 116 adjacent the boss 119, in order to firmly clamp the wire between the cam 114 and projection 121. Since the wire 131 passes through the hole 105 and behind the boss 119, there is no danger that the wire will slip sidewardly from between the cam and projection 121. If adjustment of the picture wire is required, the lever 112 may be simply returned to the position 130, and the position of the wire changed, following which the latching lever is returned to the position illustrated in FIG. 32.

While the aperture 105 has been illustrated as constituting a hole, it will be apparent that a portion of the side of this aperture may be removed, in order to simplify the installation of a wire or cord therein.

In a further modification of the invention, as illustrated in FIG. 34, a push pin hook 140, for example of the type illustrated in FIG. 17, has an upper portion 141 adapted to be affixed to the wall, for example by means of the pin 142, and a lower portion 143 formed to have a hook preferably at its lower end. The portions 141 and 143 are joined at a hinge joint 144. The hinge joint 144 may be formed in any conventional manner. For example, if the portions 141 and 143 are separately cast, they are cast with conventional hinge elements, and a pin may be provided to form the pivot joint of the hinge, in conventional manner. Alternatively, one of the hinge portions 141 or 143 may first be cast, with the other of the hinge parts then being cast employing the hinge region of the first cast member as a mold, whereby a separate operation and component for pivoting the two portions together is not necessary. While it is preferred that the pin 142 be provided in the arrangement of FIG. 34, it is apparent that the pin may be replaced by a hole through the portion 141, in order to enable the affixing of the hook to a wall by a screw or other conventional means.

The principle of the hinge of FIG. 34 may also be provided in a plastic molded push pin hook, as illustrated in FIGS. 35 and 36. In this arrangement, the hook is molded with an upper portion 150 and a lower portion 151, joined together by a molded hinge portion 152. The upper portion may be provided with one or more pins 153, installed in the assembly by the aforediscussed method in accordance with the invention. The lower portion 151 may be formed with a hook 154. The hinged portion 152 may be formed by molding the push pin hook to have a lesser thickness in the central region of the push pin.

The arrangements in accordance with the invention as illustrated in FIGS. 34–36 are particularly useful in the hanging of pictures. When a conventional hook is employed, the hook is usually first mounted to the wall, whereupon the picture wire or a hook of a picture must be installed over the hook. This latter step is frequently difficult and frustrating, since the picture wire is behind the picture, and manipulation of the wire into engagement with the hook is difficult. In the arrangement of FIGS. 34–36, however, the push pin is first assembled on a wall, for example by pressing the outer portion of the hook into the wall with a finger. The lower portion of the hook is then pivoted away from the wall, as illustrated in the solid line hook portion of FIG. 36, whereby the picture may be held horizontally above the hook and the picture wire moved into engagement with the hook within the view of the installer. The lower portion of the hook is then pivoted back to its position adjacent the wall, and the picture lowered to engage the wall in the installed position. The hook is preferably molded in a bent condition, as illustrated in FIG. 36, whereby it will be straightened to lie against a wall under the weight of a picture.

It is to be understood of course, that the pins of any of the push pins disclosed above may be installed in the base portions of their respective devices by the method in accordance with the invention, as above disclosed.

While the term "pin" as employed above has specifically been disclosed with reference to a sharpened member, it will be understood that the term refers in the following claims also to similar members, such as shafts, axles and the like.

While the invention has been disclosed and described with reference to a limited number of embodiments, it will be apparent that many variations and modifications may be made therein without departing from the invention, and it is intended in the following claims to cover each such variation and modification as falls within the true spirit and scope of the invention.

What is claimed is:

1. A push pin comprising a base having first and second opposite sides, and a pin having a blunt end completely embedded in and rigidly held by said base member, said pin having a sharpened end extending centrally from said second side, said second side having a convex surface coaxial with and adjacent said pin, said convex surface having a surface area in the vicinity of the pin that is substantially larger than the cross sectional area of said pin, and an outer surface extending radially outward with respect to said pin and an intermediate surface extending axially with respect to said pin between said convex surface and said outer surface, whereby said outer surface is further spaced from said sharpened end of said pin then said convex surface, in the axial direction of said pin.

2. The push pin of claim 1 wherein the cross section of said base at said intermediate surface is circular, and said outer surface has radially extending grooves.

3. The push pin of claim 1 wherein the outer circumference of said base is substantially circular with a non-regular edge.

4. The push pin of claim 1 wherein said first side is concave.

5. The push pin of claim 1 wherein said outer surface is convex.

6. A push pin comprising a base member having a mounting surface, and a pin having a blunt end embedded in said base member and a sharpened end extending through said mounting surface, said mounting surface having a convex portion through which said pin extends, an annular surface joining the outer radial edge of said convex portion and extending therefrom away from said pointed end of said pin, said annular surface extending axially with respect to said pin, and an outer surface extending radially outwardly from said annular surface with respect to said pin, the outer edge of said outer surface being axially spaced further from said sharpened end of said pin and the radially inner edge thereof.

7. The push pin of claim 6 wherein said outer surface is provided with radially extending grooves.

8. The push pin of claim 6 wherein said outer surface is convex.

9. The push pin of claim 6 wherein said base member has a concave push surface opposite said mounting surface.

* * * * *

UNITED STATES PATENT OFFICE
CERTIFICATE OF CORRECTION

Patent No. 3,995,821 Dated December 7, 1976

Inventor(s) Ruediger Einhorn

It is certified that error appears in the above-identified patent and that said Letters Patent are hereby corrected as shown below:

The title should read -- PUSH PIN ARTICLE --.

In the Abstract of the Disclosure, penultimate line:

"facilitte" should be -- facilitate --.

Column 10, line 60: "9" should be -- 29 --.

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*